United States Patent [19]

Yamasaki

[11] Patent Number: 4,960,110

[45] Date of Patent: Oct. 2, 1990

[54] BED-TYPE MASSAGING APPARATUS

[75] Inventor: Yoshikiyo Yamasaki, Osaka, Japan

[73] Assignees: Kabushiki Kaisha Fuji Iryoki, Osaka; Kabushiki Kaisha Japan Health, Sakai, both of Japan

[21] Appl. No.: 437,761

[22] Filed: Nov. 15, 1989

Related U.S. Application Data

[63] Continuation of Ser. No. 182,478, Apr. 15, 1988, abandoned.

[51] Int. Cl.[5] ..... A61H 15/00

[52] U.S. Cl. ..... 128/52; 128/58

[58] Field of Search ..... 128/52, 58, 57, 51, 128/53

[56] References Cited

U.S. PATENT DOCUMENTS

| | | | |
|---|---|---|---|
| 4,615,336 | 10/1986 | Fijimoto | 128/52 |
| 4,656,998 | 4/1987 | Masuda et al. | 128/57 |
| 4,662,362 | 5/1987 | Masuda et al. | 128/57 |
| 4,718,408 | 1/1988 | Barreiro | 128/52 |
| 4,721,100 | 1/1988 | Hengl | 128/52 |

FOREIGN PATENT DOCUMENTS

| | | |
|---|---|---|
| 56-95049 | 8/1981 | Japan . |
| 57-17655 | 1/1982 | Japan . |
| 59-189851 | 10/1984 | Japan . |
| 61-90664 | 5/1986 | Japan . |

*Primary Examiner*—Edgar S. Burr
*Assistant Examiner*—Tonya Lamb
*Attorney, Agent, or Firm*—Flynn, Thiel, Boutell & Tanis

[57] ABSTRACT

It is the bed-typed massaging apparatus which consists of the framed basic body of bed possible to bend by the coupler on the both sides of the longer direction, the rails possible to bend set in parallel on the both sides of the basic body, the driving device which drives the driving belt installed the roller for massaging along the rails, the adjusting device for tensioning the belt set at one side of the above-mentioned basic body, the tension unit set at another side of the basic body and the position detecting device of the roller for massaging. The roller for massaging goes and returns usually on the rail by the motion of the driving device. It is possible to massage the whole body lying down with the face upward. We utilize it as a chair at the bending situation, the rail maintained on the framed basic body made of the pipe is possible to massage partially without bending the rails. Moreover, admitting the roller for massaging into the bottom of the framed basic body of bed, it can be used for sleep and nap.

2 Claims, 4 Drawing Sheets

BED-TYPE MASSAGING APPARATUS

This application is a continuation of U.S. Ser. No. 07/182,478, filed Apr. 15, 1988, now abandoned.

BACKGROUND OF THE INVENTION

1. Field of the Invention

This invention is directed to a bed-type massaging apparatus which can massage the whole body of a person lying down and with their face upward. This apparatus can also massage an injured part of a body bent at its middle. The apparatus also can serve as a conventional bed-type massaging apparatus.

2. Description of Prior Art

The conventional bed-type massaging apparatus has a roller for massaging driven by a driving device. The roller can massage the human body by moving and running only on the guide rail it is set on. Another conventional bed-type massaging apparatus is one which the above-mentioned conventional bed-type massaging apparatus has been improved in order to make its transportation and handling easier. The improvement is making the guide rail flexible and installing it on a flexible frame body, therefore the roller for massaging can move and run, and when not being used, the basic body can be made folded to a compact size.

But the problem has arisen that, by means of this sort conventional bed-type massaging apparatus, the use of the bed body is impossible when it is bent, and besides that, because the roller for massaging is on rails all the time, it is impossible to be used as usual at the time when the roller has stopped because the existence of the roller on the rail is uncomfortable.

BRIEF SUMMARY OF THE INVENTION

Accordingly, the purpose of the invention is to offer a bed-type massaging apparatus which can be used as a bed by means of positioning the roller for massaging at its bottom. Additionally, the purpose of the invention is to offer not only a bed-type massaging apparatus which can massage the entire body, but also an apparatus which can be used as a chair by being bent at its middle and, therefore, partially massage the body.

The following detailed discussion and the attached drawings explain the above-mentioned and additional purposes and characteristics of the invention more completely and clearly. However, the drawings are shown only for illustration purposes and do not limit the scope of the present invention.

PREFERRED EMBODIMENT OF INVENTION

Figure 1:
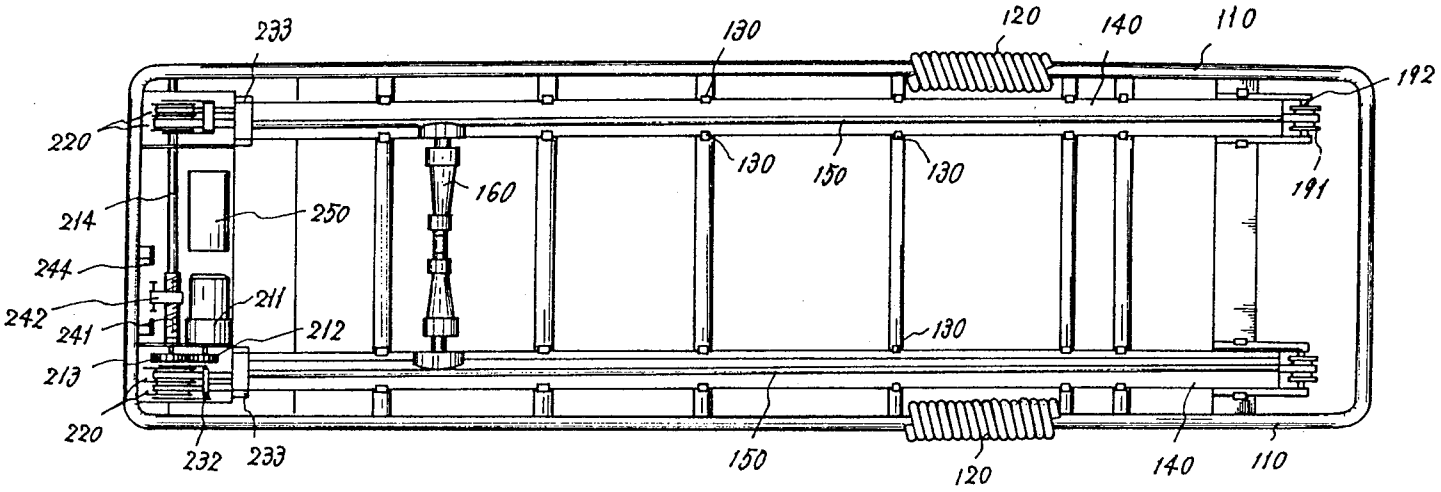
FIG. 1 is a plan view which shows an embodiment the bed-type massaging apparatus of the present invention.
Figure 2:
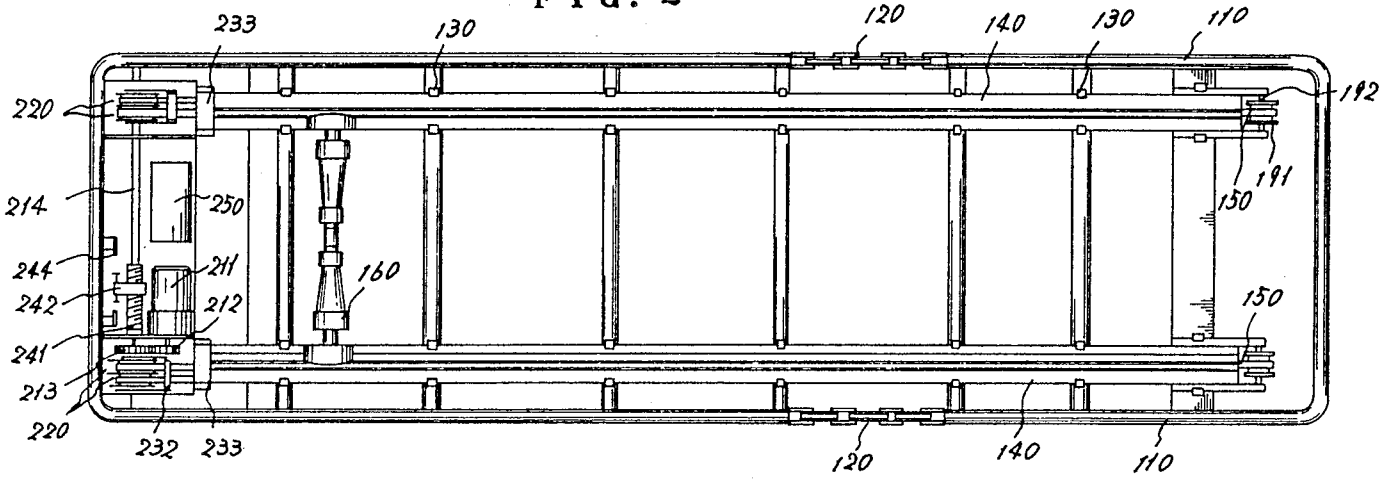
FIG. 2 is a plan view which shows another embodiment of the bed-type massaging apparatus of the present invention.
Figure 3:
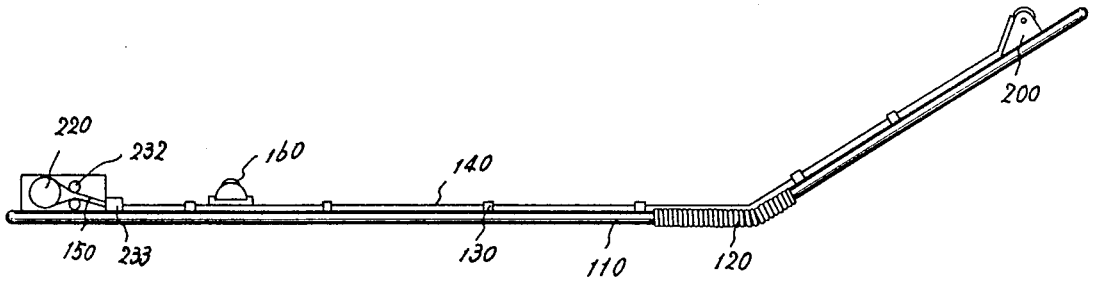
FIG. 3 is a side view which shows the bed-type massaging apparatus of FIG. 1 in a bent configuration.
Figure 4:
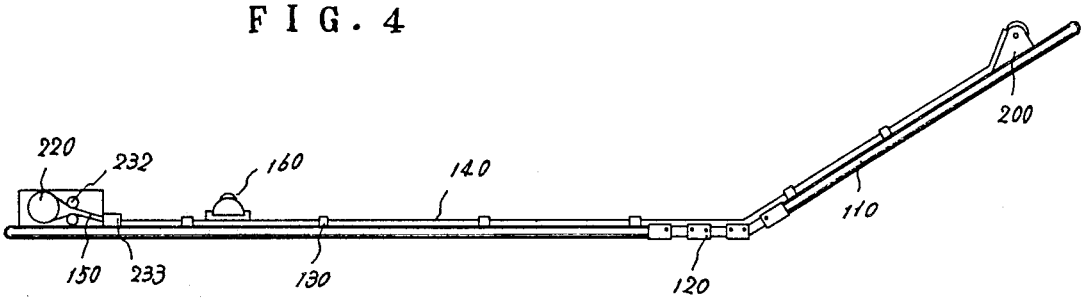
FIG. 4 is a side view which shows the bed-type massaging apparatus of FIG. 2 in a bent configuration.
Figure 5:
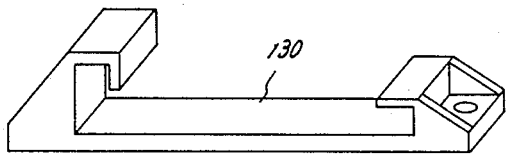
FIG. 5 is a perspective view of an embodiment of a rail guide of the present invention.

The bed-type massaging apparatus of the invention comprises a frame body 110 which can be bent near its middle. Flexible rails 140 are set in parallel at both sides of the frame body 110. A driving device 210 for driving a belt 150 equipped with a massaging roller 160 is provided along the rails 140. An adjusting device 190 for tensioning the belt 150 is set at one side of the frame body 110. A tension unit 230 is set at another side of the frame body 110 and a position detection device 240 for the roller 160.

The above-mentioned frame body 110 contains a coupler 120 consisting of coil springs or chains in pair on opposite sides and in the longitudinal direction of the frame 110 and makes it possible to bend the frame 110 nearly at its middle.

The above-mentioned flexible rails 140 are made of a resin or other flexible material. Rail guides 130 are arranged on opposite sides, right and left, within the inner side of the frame body 110. The flexible rails 140 are secured by rail guides 130 arranged in pair on opposite sides of the frame body 110.

Figure 6:
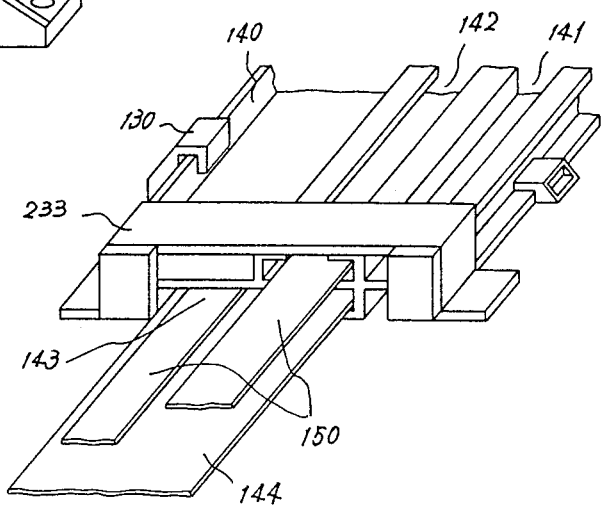
FIG. 6 is a partial diagrammatic view of a rail of the present invention.

Furthermore, as shown in FIG. 6, on the flexible rails 140, a track 141 for the guide roller is installed. An upper trough 142 and lower trough 143 for the driving belt 150 are also positioned on the guide rails 140. A belt support 144 is positioned on the lower trough 143.

Figure 7:
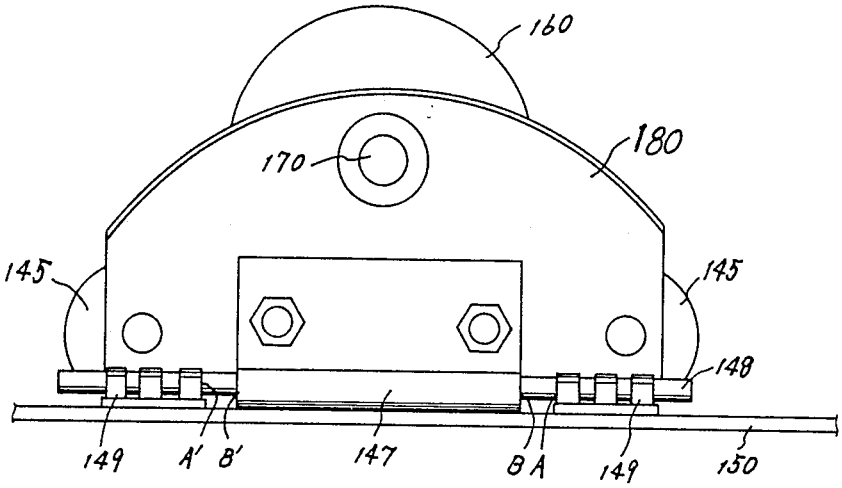
FIG. 7 is a perspective view which shows an embodiment of the maintainer of the massaging roller of the present invention.

The roller bearing 180 holds the roller shaft 170, 160 and is installed on the driving belt 150. The bearing 180 has a guide roller 145 on its inner side which rotates and runs along the above-mentioned track 141 as shown in FIG. 7. The bearing-installing plate has a tubulous part 147 attached at the outer side of its lower end. An installation stick is inserted through the tubulous part 147 and slides freely therein. The ends of the installation stick 148 are fixed on the driving belt 150 by a pair of metal fittings 149. Accordingly, when the roller 160 moves to the left, the surface of the left end A, on the right side of the metal fittings 149, comes into contact with the surface of the right end B of the bubulous part 147, and when the roller for massaging moves to the right, the surface of the right end A', at the left side of the metal fittings 149, comes into contact with the surface of the left end B of the bubulous part 147.

Moreover, 190 is an adjusting device for tensioning the belt and is positioned at one side of the above-mentioned frame body 110. The adjusting device 190 consists of a support plate 111 positioned on the upper surface of one side of the frame body 110, a roller 191 for reversing the motion of the driving belt 150 positioned on both sides of the upper surface of the support plate 111 and a bearing 200 for holding the shaft 192 of the roller 191.

Figure 8:
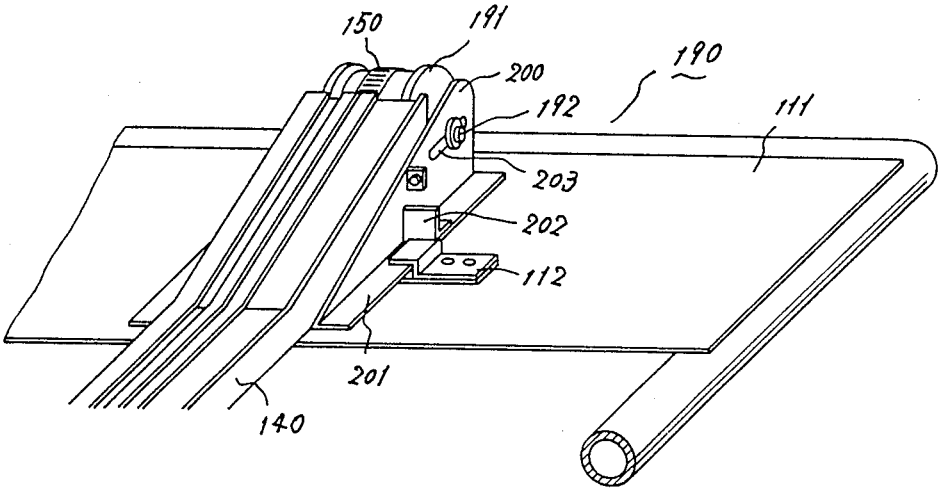
FIG. 8 is a perspective view which shows an embodiment of the adjusting device for tensioning the belt of the present invention.

Namely, as shown in FIG. 8, a slot 203 containing the shaft 192 is formed in the bearing 200. The bearing 200 comprises a sliding member 201 and is bent at its lower end to the outer side and has stopper 202 on the upper surface of the sliding member 201. The stopper 202 is welded to the metal fitting 112 which is attached to the support plate 111 controls the sliding of the above-mentioned driving device. By adjusting slidingly in the slot 203 the position of the shaft 192, it is possible to adjust the tensioning of the driving belt 150.

Figure 9:
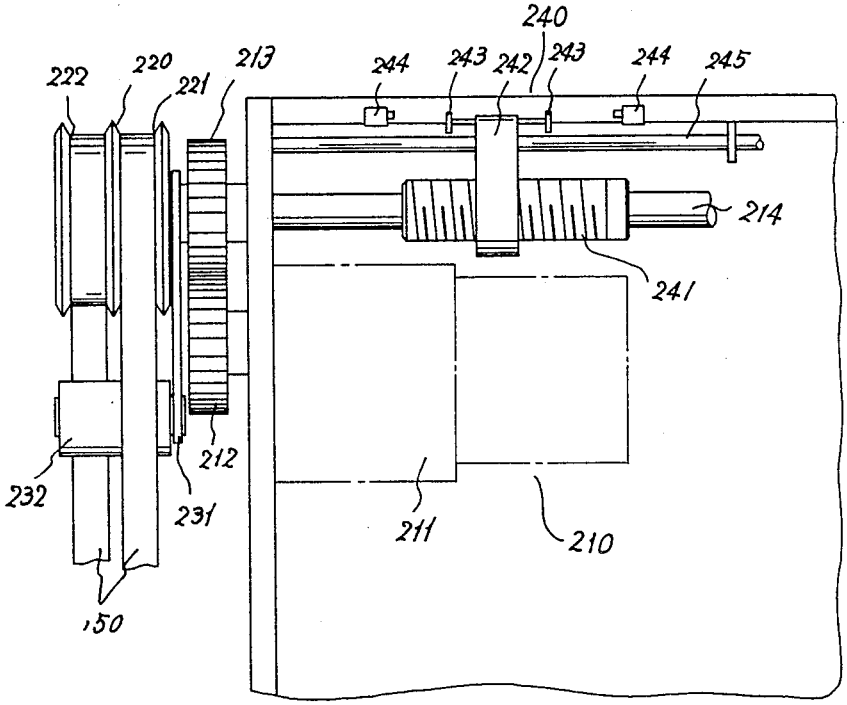
FIG. 9 is a plan view which shows an embodiment of the position detection device of the roller for massaging of the present invention.

As shown in FIG. 9, the driving device 210 consists of a motor 211 positioned at one side of the upper surface of the other side of the frame body 110, a transmission gear 213 rotating interlocked with the prime gear 212 of the motor 211, a pair of two-groove drums 220 welded to the ends of the transmission shaft 214 of the transmission gear 213 and a driving belt 150 having one end supported on each inner groove 221 of these two-groove drums 220 and having the other end supported on each outer groove 222 by the roller 191. For example, when running the motor 211 in a forward direction, the inner groove 221 of the two-groove drum 220 winds up the driving belt 150, and, on the otherhand, the outer groove 222 rewinds the driving belt 150. When running the motor 211 in the reverse direction, the outer groove 222 of the two-groove drum 220 winds up the driving belt 150 and the inner groove 221 rewinds the driving belt 150.

Figure 10:
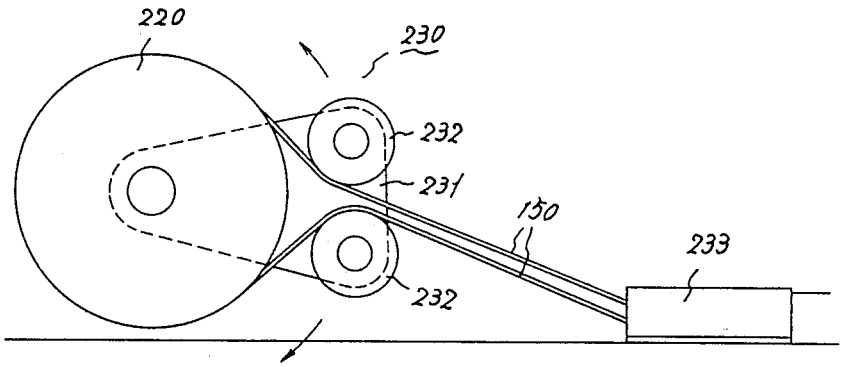
FIG. 10 is a partial diagrammatic view of a tension unit of the present invention.
Figure 11:
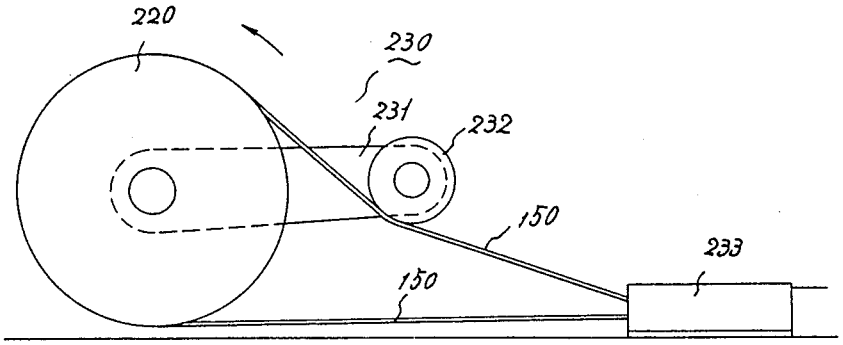
FIG. 11 is a partial diagrammatic view which shows another embodiment of the tension unit of the present invention.

The above-mentioned tension unit 230 consists of an installation plate 231 attached on the transmission shaft 214 between the inner side of the two-groove drum 220 and the transmission gear 213, a tension roller 232 puts the driving belt 150 under tension, as shown in FIG. 10 and FIG. 11, and is supported by the transmission shaft 214 and a guide pipe 233 receives the driving belt 150, which moves by the tension roller 232.

The position detecting device 240 of the roller 160 consists of a screw shaft 241 secured on the outside of the transmission shaft 214, a mover member 242 threaded onto the screw shaft and having a limit switch contacting member 243 projecting laterally therefrom, a guide bar 245 positioned in parallel with the transmission shaft 214 and over which the mover member 242 slides freely. A limit switch 244 is positioned on both sides of the limit switch contacting member 243 at an appropriate distance on the guide bar. The movement of the roller 160 is converted into the movement from right to left and left to right of the mover member 242 so as to detect the upper limit and the lower limit of the position of the roller 160.

Control base 250 contains a timer circuit and is positioned at one side of the motor 211. The control base regulates the movement of the roller 160.

The bottom and upper surface of the structure described above is completely covered by a cloth. When using the bed-type massaging apparatus of the present invention, it can be positioned to either massage the whole body by shaping the frame body 110 into a bed, or to massage a specific area by bending the frame body 110 into the form of an easy chair. By revolving the motor 211, the prime gear 212 rotates. The transmission shaft 214 rotates through the transmission gear 213 rotating and gearing with the prime gear 212. It is possible to have the driving belt 150 run along the flexible rail 140 by the two-grooved drums 220 installed on the ends of the transmission shaft 214. We can massage suitably by the roller 160 installed in the driving belt 150.

Moreover, because the adjusting device for tensioning the belt is installed in the invention, the curving of the flexible rail tension from the side of the driving device when using high power on driving is prevented by the stopper 202 and the metal fittings 112. When used at the time of bending, the bending radius of the flexible rail 140 is small and because the flexible rail 140 needs room at the head of the structure, the bearing 200 can slide on the support plate 111 by sliding part 201.

What is claimed is:

1. A bed-type massaging apparatus comprising a flexible frame body having a pair of flexible rails disposed in parallel relationship, each of said flexible rails comprising a flexible coupler; a driving means for moving a belt in a reciprocating fashion, said driving means comprising a reversible motor having an output shaft and a driving gear attached thereto and a transmission shaft having a transmission gear attached thereto and meshed with said driving gear; a massaging roller attached to said belt; tensioning means for adjustingly regulating the tension of said belt, said tensioning means comprising an adjusting device positioned at one side of the frame body and means for placing said belt under tension provided at another side of said frame body; position detection means for determining the location of said massaging roller, said position detection means comprising a screw shaft secured on an outside surface of said transmission shaft; a mover member threaded onto said screw shaft so that the rotation of said screw shaft imparts linear movement to said mover member, a limit switch contacting member attached to said mover member and extending laterally therefrom, a guide bar positioned in parallel relationship with said transmission shaft, and limit switches positioned on said guide bar so as to confine the movement of said limit switch contacting member therebetween; and control means for regulating the location of said massaging roller along said flexible rails.

2. The bed-type massaging apparatus of claim 1, wherein said flexible coupler is selected from the group consisting of springs and chains.

* * * * *